US006768939B2

(12) United States Patent
Grass et al.

(10) Patent No.: US 6,768,939 B2
(45) Date of Patent: Jul. 27, 2004

(54) METHOD AND DEVICE FOR CHECKING THE PERFORMANCE RELIABILITY OF A TIMER

(75) Inventors: Gerd Grass, Schwieberdingen (DE); Ruediger Weiss, Moetzingen (DE)

(73) Assignee: Robert Bosch GmbH, Stuttgart (DE)

( * ) Notice: Subject to any disclaimer, the term of this patent is extended or adjusted under 35 U.S.C. 154(b) by 215 days.

(21) Appl. No.: 09/942,414

(22) Filed: Aug. 29, 2001

(65) Prior Publication Data

US 2002/0029766 A1 Mar. 14, 2002

(30) Foreign Application Priority Data

Sep. 1, 2000 (DE) ..... 100 43 500

(51) Int. Cl.[7] ..... G06G 7/70
(52) U.S. Cl. ..... 701/114; 700/79
(58) Field of Search ..... 701/114, 115, 701/34, 66; 700/79

(56) References Cited

U.S. PATENT DOCUMENTS 4,271,402 A * 6/1981 Kastura et al. ..... 340/459
5,081,586 A * 1/1992 Barthel et al. ..... 701/49
5,406,483 A * 4/1995 Kallis et al. ..... 701/53
5,938,723 A * 8/1999 Hales et al. ..... 709/204
5,942,988 A * 8/1999 Snyder et al. ..... 340/825.69
6,131,062 A * 10/2000 Nielsen ..... 701/50
6,252,826 B1 * 6/2001 Kaizu et al. ..... 368/120
6,530,023 B1 * 3/2003 Nissl et al. ..... 713/200
2001/0017600 A1 * 8/2001 Torikoshi et al. ..... 342/357.12

FOREIGN PATENT DOCUMENTS

| | | |
|---|---|---|
| DE | 196 21 900 | 12/1997 |
| DE | 196 37 088 | 3/1998 |
| DE | 196 44 497 | 4/1998 |
| DE | 196 52 645 | 6/1998 |

* cited by examiner

*Primary Examiner*—Willis R. Wolfe
*Assistant Examiner*—Johnny H. Hoang
(74) *Attorney, Agent, or Firm*—Kenyon & Kenyon

(57) ABSTRACT

A method and a control unit are proposed for checking the performance reliability of a timer that is arranged outside of the control unit, used in particular for controlling an internal combustion engine, and that supplies time information to the control unit, further time information being generated internally in the control unit and being compared to corresponding time information supplied by the external timer. Because an internal time meter is started in the control unit and the comparison of the time information supplied by the external timer and by the internal time meter is carried out at arbitrarily specifiable points of time, a malfunction of the external timer can be determined during the entire operating time, and furthermore, a deviation can be calculated with higher accuracy.

10 Claims, 2 Drawing Sheets

METHOD AND DEVICE FOR CHECKING THE PERFORMANCE RELIABILITY OF A TIMER

FIELD OF THE INVENTION

The present invention relates to a method, a device and a control unit for checking the performance reliability of a timer which is arranged outside of the control unit, used in particular for controlling an internal combustion engine, and which provides the control unit with time information, time information being generated internally in the control unit and being compared to corresponding time information supplied by the external timer.

BACKGROUND INFORMATION

Time information can be needed in various ways by a control unit. For controlling internal combustion engines, the knowledge of the time duration after the engine is switched off until the start once again is advantageous for controlling the further driving process. Depending on the length of the engine shutdown time, the injection time for the start can be corrected, the model for the exhaust-gas temperature can be pre-initialized accordingly, and catalytic-converter heating measures can be taken or forestalled. Furthermore, in the case of long shutdown times, automatic diagnostic tests can be enabled.

The shutdown time can be calculated from three different information sources. Short shutdown times can be yielded from a time measurement during the control-unit after-running. For long shutdown times, calculation models exist which ascertain the shutdown time from the cooling off of the engine (German Published Patent Application No. 19644497). Finally, to ascertain accurate shutdown time information, it is possible to use an external timer, e.g. an on-board clock located outside of the control unit. To that end, the control unit is designed such that, at desired points of time, the time data of the on-board clock are read out and subsequently processed. Such a method is described in German Published Patent Application No. 196 21 900.

German Published Patent Application No. 196 37 088 describes a control system for a motor vehicle, in which the instant the engine is switched off is transmitted by the on-board clock via a CAN data bus to the engine control unit. The same holds true for the instant of re-igniting the engine, so that the engine shutdown time can be calculated from the time difference, and the catalytic-converter temperature can be determined as a function of this engine shutdown time. A plausibility check of the time information supplied by the on-board clock is not carried out here.

A comparison of the shutdown time, calculated from the external clock information, to the shutdown time calculated from the engine cooling is too imprecise for a plausibility check, particularly in the case of brief shutdown times. In addition, the operation of block heaters or auxiliary heating can strongly influence the shutdown time calculated from the engine cooling.

German Published Patent Application No. 196 52 645 describes a method of this type for checking the performance reliability of an external timer. In that case, a software timer in the control unit is started with a specifiably defined time interval, and the external time information (e.g. of an on-board clock) is read out at the beginning and at the end of this time interval. The external time interval ascertained from this is subsequently compared to that of the software timer. If a deviation is determined which exceeds a specifiable extent, a malfunction of the external timer is detected.

A disadvantage of the known method is that the plausibility check is carried out only once in relation to the relatively brief time interval of the software timer. In contrast, the objective in the present case is to specify an improved method with which, in particular, the plausibility check is carried out with higher accuracy.

SUMMARY OF THE INVENTION

In the method according to the present invention, an internal time meter is started in the control unit, and the time information supplied, first of all, by the time meter internal to the control unit, and secondly by the external timer is compared at arbitrarily specifiable points of time. This has the advantage that a plausibility check can be carried out during the entire operating time of the control unit and specific to the total operating time. Thus, it is possible both to detect a fault of the external timer at any time during the operating time, as well as to increase the accuracy in calculating the deviation.

To this end, it is advantageous to carry out the plausibility check over the entire operating time of the control unit, i.e. of the internal time meter. First of all, this allows conclusions about the performance reliability of the external timer during the entire engine operation. Furthermore, short-duration disturbances, for example, during the transmission of the time information from the external timer to the control unit, can be ascertained during the fault analysis, since the check is carried out over the entire period of time of the engine operation.

It is advantageous to start the time meter, internal to the control unit, when the ignition of the internal combustion engine is switched on, in order to immediately check the time information, supplied by the external timer, for plausibility.

Furthermore, directly after the start of the internal time meter (for example, after ignition has been effected), the signal supplied by it can be checked for the presence of time information in order to be able to immediately detect a complete failure. The check for the presence of time information can be carried out independently of the fact that the internal time information is compared to the external time information (in so far as existing).

The plausibility check is carried out in a simple manner, for example, in that predetermined time segments which are defined by the internal time meter are in each case compared to the corresponding time segments derived from the external timer. It is also possible to constantly form the ratio of the total time spans since the switch-on of the control unit (or another defined point of time, e.g. engine start) of the internal and external time information. To this end, the corresponding signal of the external timer is advantageously supplied to the control unit and further processed there. For example, the deviation is calculated, or a ratio of the corresponding time segments is formed, the external time information being recognized as faulty when the deviation exceeds a specific threshold value or lies outside of a predetermined interval. It is then useful to enter corresponding fault information into a fault storage. When the engine is started again, the fault information can then be read out from the fault storage, and the determination of the shutdown time can be omitted. A new plausibility check can subsequently be carried out, to be able to determine whether the fault of the external timer was eliminated.

DETAILED DESCRIPTION

Figure 1:
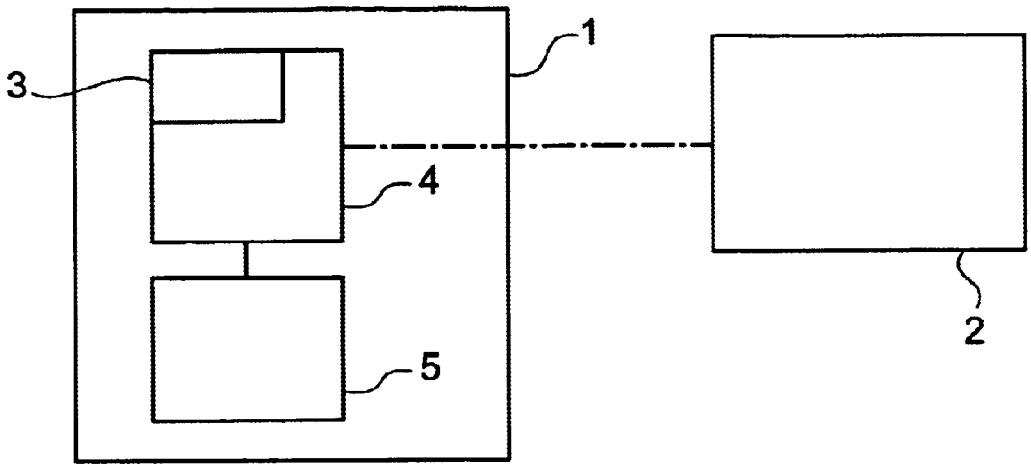
FIG. 1 shows schematically a design layout with a control unit according to the present invention for checking the performance reliability of an external timer.

In the following, an exemplary embodiment of the present invention and its advantages shall be explained in greater detail with reference to the Drawing. FIG. 1 shows a control unit 1, used for controlling an internal combustion engine, having a computer unit 4 (CPU) and a storage unit 5 (RAM). The information, used for controlling the internal combustion engine and for carrying out the present method according to the present invention, is supplied to the control unit by external sensors.

Figure 2:
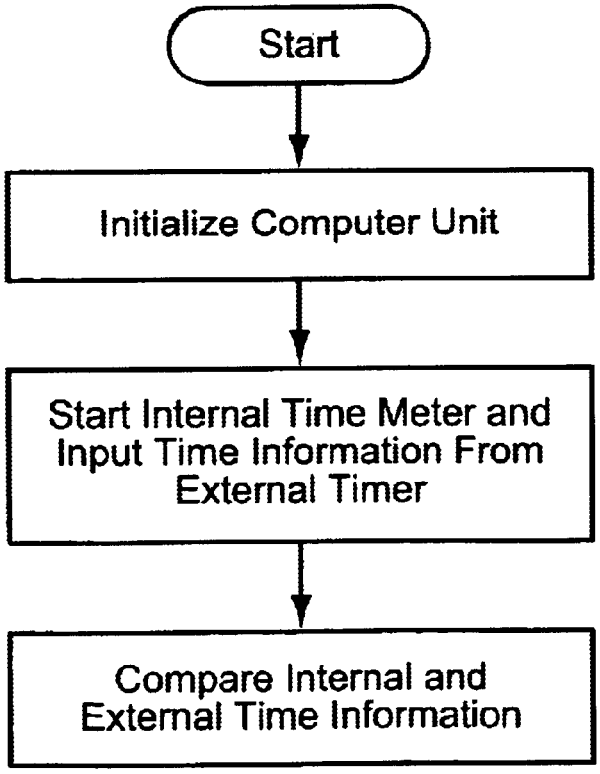
FIG. 2 shows a flowchart of the steps for checking performance reliability to be undertaken in the control unit according to the present invention.

On its part, the control unit emits the triggering signals. FIG. 1 shows the elements of control unit 1. In this exemplary embodiment, the on-board clock (instrument cluster) is used as external timer 2 which is connected to control unit 1 in such a way that continuous access to the time information supplied by the on-board clock is possible, The sequence for the performance-reliability check is roughly sketched in FIG. 2. After the start of the control unit or of the engine or at another point of time to be defined, computer unit 4 (CPU) is initialized and then, on its part, starts internal time meter 3 which can be integrated in the CPU. At the same time, the time information transmitted by external timer 2 is input. The time information can be transmitted via a cable, but also by sending out electromagnetic signals. External and internal time information is subsequently compared, which can be done by subtraction or ratio formation. Other comparison possibilities are also open to one skilled in the art. The deviation is calculated in the CPU, and a fault is detected when, for example, in the case of subtraction, the difference amount exceeds a predefined threshold value, or in the case of ratio formation, the calculated ratio lies outside of a predefined interval between two threshold values.

Figure 3:
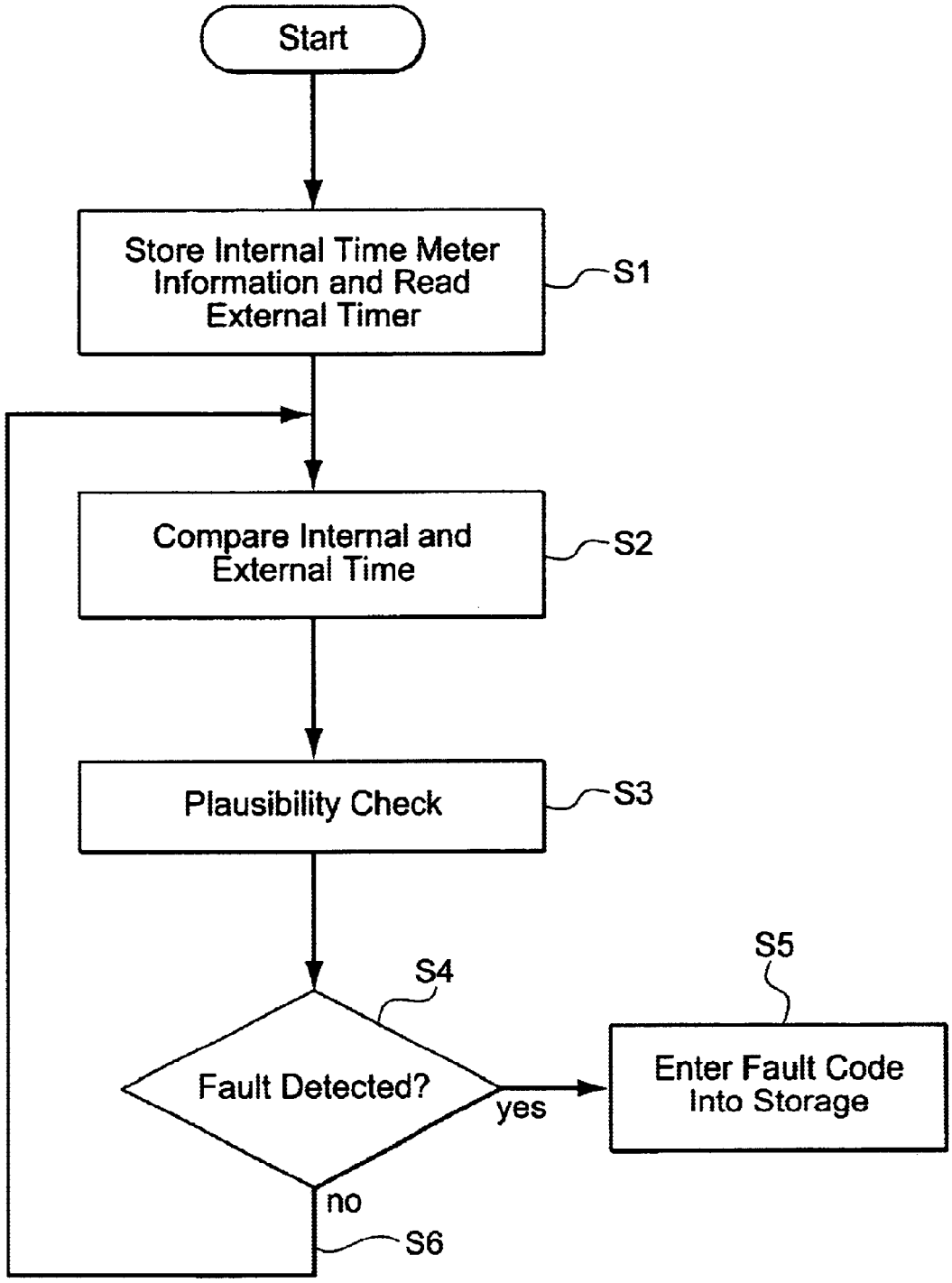
FIG. 3 shows schematically a flowchart of an exemplary embodiment of the method according to the present invention.

The sequence shown in FIG. 3 for the check, according to the present invention, of the performance reliability of external timer 2 advantageously begins with the switch-on of the ignition, an internal time meter 3 being started when control unit 1 is switched on, and point of time t1 being read from external timer 2 (step S1). Internal time meter 3 is in each case incremented in established time segments, a fixed correlation existing between internal time segments and external time intervals (time intervals supplied by the on-board clock). According to the present invention, a comparison with the time interval supplied by the on-board clock can be carried out after each time segment or after a specific number of such time segments or continuously. A plausibility check should be carried out as soon as possible after the ignition is switched on, in order to decide whether the shutdown time of the engine can be correctly determined. During further operation, further plausibility checks can be carried out at greater time intervals or continuously. In this context, the total operating time of internal time meter 3 can always be used as reference quantity for the comparison in order to increase the accuracy when determining a possible deviation.

The comparison can be made at a point of time t2 in a manner known per se, by forming a ratio of externally measured time interval (dt=t2−t1) and internally measured time interval (dti), possibly after conversion to a common unit of time. If deviation (f_t) lies outside of a predefined interval ($S_f_u$ . . . $S_f_o$) the external timer is classified as defective (steps S2 through S4).

If a fault is detected, a corresponding fault code is entered into a fault storage 5 located in control unit 1 (step S5). The fault code indicates that the external time information should not be utilized for the further control of the internal combustion engine, so that a calculation of the shutdown time of the engine is omitted during a new driving cycle. To check whether the fault of external timer 2 has been eliminated in the meantime, after a new engine start, a plausibility check can be carried out again according to the method of the present invention.

If no fault is detected (step S4), a comparison of time intervals (dt, dti) elapsed until then can take place again at a specifiable further point of time t2.

The present invention makes it possible to determine a failure or a fault of an external timer at any point of time at all while the control unit is activated. By reference to the total operating time, a deviation of the external timer and the internal time meter can be determined with high accuracy, and a short-duration disturbance can be ascertained by the selection of suitable threshold values.

What is claimed is:

1. A method for checking a performance reliability of an external timer that is arranged outside of a control unit and that supplies the control unit with time information, comprising the steps of:

generating time information internally in the control unit;

comparing the generated time information to corresponding time information supplied by the external timer;

starting an internal time meter in the control unit; and comparing time information supplied by the internal time meter to the time information supplied by the external timer at arbitrarily specifiable points of time.

2. The method according to claim 1, wherein:

the control unit controls an internal combustion engine.

3. The method according to claim 1, wherein:

the step of comparing the time information supplied by the internal time meter to the time information supplied by the external timer is performed over an entire operating time of the internal time meter.

4. The method according to claim 1, wherein:

a start of the internal time meter occurs with a switch-on of an ignition of an internal combustion engine.

5. The method according to claim 1, further comprising the step of:

directly after a start of the internal time meter, checking a signal supplied by the external timer for a presence of time information.

6. The method according to claim 1, further comprising the steps of:

comparing time segments supplied by the external timer to time segments supplied by the internal time meter; and in response to one of a deviation over a predetermined threshold value and upon exceeding a predetermined interval, recognizing the external timer as faulty and entering a corresponding fault code into a fault storage of the control unit.

7. A control unit for checking a performance reliability of an external timer that is arranged outside of the control unit and that is operatively connected to the control unit in order to transmit time information, comprising:

a computer unit for comparing the time information transmitted by the external timer to time information generated internally in the control unit; and an internal time meter operatively connected to the computer unit such that the time information generated by the internal time meter can be compared to the time information transmitted by the external timer at arbitrarily specifiable points of time.

8. The control unit according to claim 7, wherein:

the control unit controls an internal combustion engine.

9. The control unit according to claim 7, further comprising:

a storage unit connected to the computer unit, wherein: in response to a deviation of the time information generated by the internal time meter and the time information transmitted by the external timer that is one of above a predetermined threshold value and outside of a predefined interval, a fault code can be entered into the storage unit.

10. A device, comprising:

an external timer; and a control unit connected to the external timer, the control unit including:

a computer unit for comparing time information transmitted by the external timer to time information generated internally in the control unit, and an internal time meter operatively connected to the computer unit such that the time information generated by the internal time meter can be compared to the time information transmitted by the external timer at arbitrarily specifiable points of time.

* * * * *